US005353686A

United States Patent [19]

Nakamura

[11] Patent Number: 5,353,686

[45] Date of Patent: Oct. 11, 1994

[54] HYDRAULIC CIRCUIT FOR FOUR-POSITION CLOSED-CENTER SELECTOR VALVE CONTROLLED BY PRESSURE PROPORTIONAL CONTROL VALVE

[75] Inventor: Mitsuaki Nakamura, Komatsu, Japan

[73] Assignee: Kabushiki Kaisha Komatsu Seisakusho, Tokyo, Japan

[21] Appl. No.: 67,785

[22] Filed: May 25, 1993

[30] Foreign Application Priority Data

May 25, 1992 [JP] Japan ..... 4-156132

[51] Int. Cl.[5] ..... F15B 13/06; F15B 13/042

[52] U.S. Cl. ..... 91/461; 91/464; 137/625.6; 137/636.2; 251/297

[58] Field of Search ..... 91/461, 464; 137/625.6, 137/636.2; 251/297

[56] References Cited

U.S. PATENT DOCUMENTS

| | | | |
|---|---|---|---|
| 2,958,233 | 11/1960 | Johnson | 137/636.2 X |
| 3,160,174 | 12/1964 | Schmiel et al. | 91/464 X |
| 4,342,335 | 8/1982 | Reinicker et al. | 251/297 X |
| 4,354,527 | 10/1982 | McMillan | 91/464 X |
| 4,355,660 | 10/1982 | Huffman | 91/464 X |
| 4,397,336 | 8/1983 | Godfrey | 137/636.2 |
| 5,038,825 | 8/1991 | Hilmer et al. | 91/464 X |

FOREIGN PATENT DOCUMENTS 61-119677 7/1986 Japan .

*Primary Examiner*—Gerald A. Michalsky

*Attorney, Agent, or Firm*—Richards, Medlock & Andrews

[57] ABSTRACT

A hydraulic circuit, having a four-position closed-center valve (6) controlled by a proportional control valve (22), can facilitate the vertical position control and operating speed control of a blade with a simple structure, while providing that the floating condition of the blade can be precisely recognized by the position of a control lever (20*a*). The spool (41) of the four-position selector valve (6) has a "hold" position which is given by the closed-center position. Opposite ends of the spool (41) receive a pilot pressure from the pressure proportional control valve (22), one position being obtained by applying pilot pressure to a first end of the spool (41), and two positions being obtained by applying pilot pressure to the second end of the spool (41). One of the latter two positions is a "floating" position, while the other two positions are the "up" position and the "down" position. The control lever (20*a*) for the pressure proportional control valve (22) can have a detent device for fixing the control lever at the "floating" position.

15 Claims, 6 Drawing Sheets

HYDRAULIC CIRCUIT FOR FOUR-POSITION CLOSED-CENTER SELECTOR VALVE CONTROLLED BY PRESSURE PROPORTIONAL CONTROL VALVE

FIELD OF THE INVENTION

The present invention relates to an improvement in a hydraulic circuit for a four-position closed-center selector valve controlled by a pressure proportional control valve, with the hydraulic circuit being suitable for use with construction machines or the like.

BACKGROUND OF THE INVENTION

FIG. 5 shows a hydraulic circuit, containing a four-position selector valve 101, which has been used with a conventional construction machine, a material handling machine or the like, and which is adapted to be operated by a manual control lever 102. The four positions of the four-position selector valve 101 are the "up" position, the "hold" position, the "down" position, and the "floating" position. For example, the selector valve 101 can be set at the "floating" position so as to cause the blade cylinders 103 to be freely operatable while the vehicle body is moved backwardly in order to level the land with the use of a blade (not shown), under the deadweight of the blade. Further, in order to enhance the manipulability of the control lever 102, a detent 104 is incorporated so as to hold the "floating" position when the control lever 102 is moved to the "floating" position and then released by the operator.

In recent years, a closed-center load sensing circuit has been used in order to satisfactorily control the vertical position and the operational speed of the blade. In the hydraulic circuit shown in FIG. 6, each of selector valves 111, 112 has three positions and is changed over by a pressure proportional control valve 113, 114. However, no "floating" position is provided in the selector valve 112 for the blade cylinder 115. The floating operation of the blade cylinder 115 is carried out with the use of an arrangement comprising logic valves 120, 121. The logic valve 120 is disposed in conduit 118 which extends from an "up" port 116 of selector valve 112 to a first port of blade cylinder 115, while the logic valve 121 is disposed in conduit 119 which extends from a "down" port 117 of selector valve 112 to the second port of blade cylinder 115. Each of logic valves 120, 121 is connected to a reservoir tank 127 by way of a return conduit 126 through the intermediary of a solenoid selector valve 123. A solenoid relief valve 124 is connected between the conduit 119 and the return conduit 126. In this hydraulic circuit, the solenoid selector valve 123 is operated by depressing a floating switch (not shown), which is incorporated in the manual control lever 125, so as to simultaneously open the logic valves 120, 121, and thereby connect both of the conduits 118, 119 to the reservoir tank 127 by way of the return conduit 126 so as to allow the blade to be in a condition of floating operation. At the same time, the solenoid relief valve 124 avoids any excessive pressure in the blade cylinder 115 which would be caused by a force from the ground.

However, with the manually controlled circuit shown in FIG. 5, the control of the vertical position of the blade is inferior, and the control of the operation speed is difficult. Further, in a large size construction machine, the size of the selector valve 101 becomes larger as the necessary flow rate of hydraulic fluid is higher, and accordingly, either the control force has to be larger or the stroke of the control lever 102 has to be longer. Accordingly, a problem arises in that such operation tires the operator, thereby lowering the workability of the system.

The hydraulic circuit illustrated in FIG. 6, which has been proposed to eliminate the above-mentioned problem with the system of FIG. 5, requires the presence of the logic valves 120, 121 and the solenoid selector valve 123 in the conduits 118, 119 extending from the "up" and "down" ports 116, 117 to the blade cylinder 115 in order to obtain a "floating" position, and accordingly, the structure becomes large and complicated. In particular, in a large size construction machine, the logic valves 120, 121 and the solenoid selector valve 123 become large, and accordingly, the solenoid assemblies for operating these valves become larger.

Further, in order to set the blade at a "floating" position in a system where the control lever 125 is set at the "floating" position with the use of a detent, which is provided for the selector valve 112 similar to the detent 104 in the manually controlled circuit of FIG. 5, the selector valve 112 is moved to the "floating" position. However, if the control lever 125 is released to be free, the control lever 125 moves to a "hold" position under the reaction force of a spring 114*a* in the pressure proportional control valve 114. Accordingly, a problem arises in that the operator has difficulty recognizing, from the position of the control lever 125, a condition in which the blade is actually floating.

SUMMARY OF THE INVENTION

The present invention is devised in view of the above-mentioned problems. Accordingly, one object of the present invention is to provide a hydraulic control circuit for a four-position closed-center selector valve which can easily control the vertical position and operational speed of a blade, while permitting the operator to recognize a floating condition of the blade from the position of a control lever. Another object of the present invention is to provide a hydraulic control circuit containing a four-position closed-center selector valve controlled by a pressure proportional control valve, wherein the control circuit has a simple structure.

According to the present invention, the hydraulic control circuit has a four-position closed-center selector valve which is adapted to be changed over by a pilot pressure signal from a pressure proportional control valve. A valve spool is incorporated in the four-position closed-center selector valve and has opposing first and second ends, each of which can receive a pilot pressure signal from the pressure proportional control valve. In addition to its closed-center position as a "hold" position, the four-position closed-center selector valve has one position, e.g., a "first direction of operation" position, which is set up when the pilot pressure signal is applied to the first end of the spool, and two positions, e.g., a "second direction of operation" position and a "floating" position, which are sequentially set up when the pilot pressure signal is applied to the second end of the spool.

Further, the four-position closed-center valve incorporates an element which does not act when the valve spool is shifted from the "hold" position to the "non-floating" position (i.e., the "second direction of operation" position) that is initially set up when the pilot pressure signal is applied to the second end of the spool, but acts only when the valve spool is further shifted from the "non-floating" position to the "floating" position which is the second one of the two positions which are set up when the pilot pressure signal is applied to the second end of the spool.

Further, the pressure by which the spool is shifted for a maximum stroke, overcoming the maximum load of the spring acting at the "floating" position, is set by a relief valve for the pilot pressure signal from the pressure proportional control valve.

With this arrangement, the four-position closed-center selector valve is reliably changed over by the pilot pressure signal fed from the pressure proportional control valve so as to facilitate the four-position control, and the circuit structure can be simplified. Moreover, since the spring which acts only when the four-position closed-center selector valve is shifted from the "second direction of operation" position to the "floating" second position is incorporated in the four-position closed-center selector valve, the "second direction of operation" position and the "floating" position are readily distinguished from each other so as to eliminate erroneous operation, and accordingly it is possible to enhance the safety of the operations. Since a certain distance can be ensured between the "second direction of operation" position and the "floating" position, a manufacturing error in the tolerances of the detent device which is incorporated in the control lever can be absorbed. Further, since the pressure for shifting the valve spool by a maximum stroke is set by the relief valve for the pilot pressure signal from the pressure proportional control valve at the "floating" position, it is possible to recognize the "floating" position by checking a pressure regulated by the relief valve. Moreover, the stroke position of the selector valve with respect to the detent device can be easily adjusted.

In addition, since the detent device which fixes the control lever at the "floating" position is incorporated in the control lever which is provided in the vicinity of the driver's seat, the four-position closed-center selector valve can be fixed at the "floating" position whenever the control lever is fixed at the "floating" position, thereby making it possible for the operator to readily recognize a "floating" condition of the blade from the position of the control lever.

DETAILED DESCRIPTION

Figure 1:
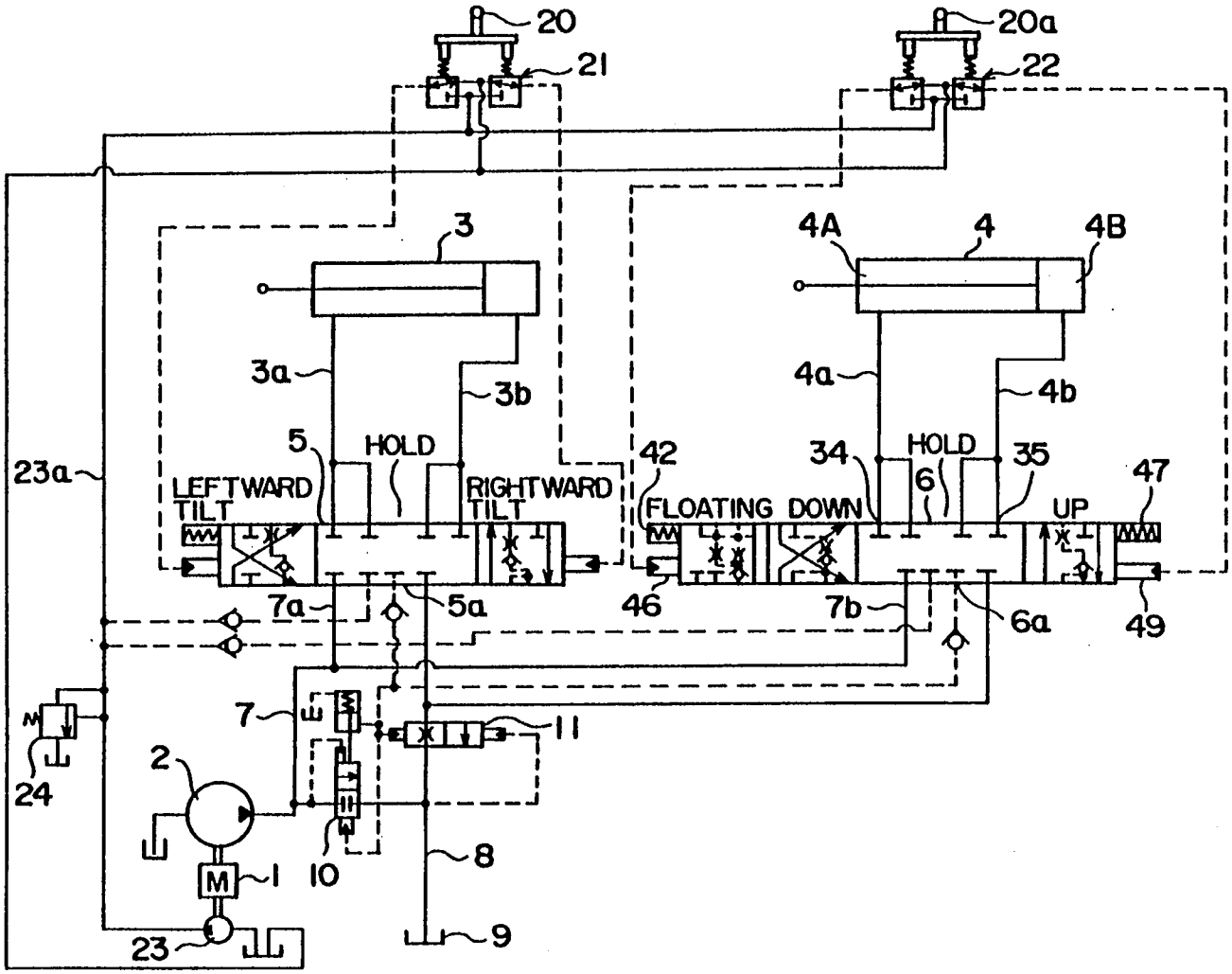
FIG. 1 is a diagrammatic illustration of a hydraulic circuit for a four-position closed-center selector valve controlled by a pressure proportional control valve in accordance with a preferred embodiment of the present invention.

A preferred embodiment according to the present invention is described hereinafter with reference to FIGS. 1–4 of the drawings. Referring now to FIG. 1, the hydraulic circuit comprises a working machine pump 2 which is driven by a power source 1 (such as an engine), a tilt cylinder 3 for turning a blade (not shown) relative to the ground surface, a blade cylinder 4 for moving the blade vertically, a stack type three-position closed-center selector valve 5 (which will be hereinafter denoted as a "three-position selector valve") for charging and discharging pressurized hydraulic fluid to and from the tilt cylinder 3, and a stack type four-position closed-center selector valve 6 (which will be hereinafter denoted as "four-position selector valve") for charging and discharging pressurized hydraulic fluid to and from the blade cylinder 4. Each of the three-position selector valve 5 and the four-position selector valve 6 has a pump port which is coupled to the pump output conduit 7 by means of a branch conduit *7a, 7b*. Each of the three-position selector valve 5 and the four-position selector valve 6 has a drain port which is connected to a hydraulic fluid reservoir tank 9 by means of a return conduit 8. Two ports of the three-position selector valve 5 are connected to the two ports of the tilt cylinder 3 by conduits *3a, 3b*, while two ports of the four-position selector valve 6 are connected to the two ports of the blade cylinder 4 by conduits *4a, 4b*.

The three-position selector valve 5 is adapted to set the tilt cylinder 3 at one of three usually used positions, that is, a "leftward tilt" position, a "hold" position and a "rightward tilt" position. The four-position selector valve 6 is adapted to set the blade cylinder 4 at one of four positions, that is, an "up" position, a "hold" position, a "down" position and a "floating" position.

A load sensing valve 10 is disposed between the pump outlet conduit 7 and the drain conduit 8. The load sensing valve 10 senses the output pressure from the pump 2, and carries out control such that any excess flow of hydraulic fluid from the outlet of pump 2 is diverted through valve 10 and return conduit 8 into the reservoir tank 9. A pressure compensating valve 11, which is disposed in the conduit 8 leading to the tank 9, prevents the "up" port of four-position selector valve 6 from experiencing a vacuum condition upon a downward stroke of the blade cylinder 4. Each of selector valves 5, 6 has a load sensing port *5a, 6a*, which is closed at the "hold" position but which otherwise provides a pressure through a check valve to one end of pressure compensating valve 11 and one end of load sensing valve 10. The pump outlet pressure is applied to the other end of load sensing valve 10.

The three-position selector valve 5 and the four-position selector valve 6 are changed over in response to pressure instructions from pilot pressure proportional control valves 21, 22 (which will be hereinafter denoted as "pilot valves") controlled by control levers 20, 20*a* arranged in the vicinity of the driver's seat (not shown). The pilot valves 21, 22 are connected by a conduit 23*a* to a source of pilot pressure, e.g., pilot valve pump 23 (which will be hereinafter denoted as "pilot pump"), and a relief valve 24 is connected to the conduit 23*a* at a point between the pilot pump 23 and the pilot valves 21, 22. Further, hydraulic pressure is delivered from the pilot valves 21, 22 in accordance with degrees of manipulation to the control levers 20, 20*a*, and therefore, hydraulic pressure is fed from the ports *5a, 6a* of the selector valves 5, 6 to the load sensing valve 10 and the pressure compensating valve 11.

It is noted that the control levers 20, 20*a* are actually integrally incorporated together although they are shown separately in FIG. 1. Thus, when the consolidated control lever is tilted downwardly and forwardly in the longitudinal direction, with respect to a vehicle advance direction, the blade cylinder 4 is operated in a first direction; when the consolidated control lever is tilted downwardly and rearwardly in the longitudinal direction, with respect to a vehicle advance direction, the blade cylinder 4 is operated in the direction which is opposite to the first direction of operation of the blade cylinder 4; when the consolidated control lever is tilted downwardly and leftwardly in the lateral direction, the tilt cylinder 3 is operated in a first direction; and when the consolidated control lever is tilted downwardly and rightwardly in the lateral direction, the tilt cylinder 3 is operated in the direction which is opposite to the first direction of operation of the tilt cylinder.

Next details of a four-position selector valve 6 according to the present invention will be described with reference to FIGS. 1 and 2. An elongated at least generally cylindrical spool bore 31 is formed through the central portion of the body 30 of the four-position selector valve 6. A plurality of ring-like inner grooves 32*a* through 32*e* are formed in the body 30 in the wall of spool bore 31. These annular grooves 32*a* through 32*e* are spaced apart from each other along the longitudinal axis of the spool bore 31 in the sequence of groove 32*d*, groove 32*b*, groove 32*a*, groove 32*c*, and groove 32*e*. The centrally located groove 32*a* is connected to pump port 33 in body 30. The groove 32*b* is connected by a passageway 30*a* in body 30 to a first control port 34 which is connected to the rod side 4A of the blade cylinder 4. The groove 32*c* is connected by a passageway 30*b* in body 30 to a second control port 35 which is connected to the bottom side 4B of the blade cylinder 4. Each of the grooves 32*d* and 32*e* is connected to a port (not shown) in body 30 which is connected to the drain conduit 8 and thus to the reservoir tank 9.

An at least generally cylindrical spool 41, having opposing first and second ends, is tightly but slidably fitted within the spool bore 31 for movement along the longitudinal axis of spool bore 31. The spool 41 has a plurality of annular grooves formed in its cylindrical surface at spaced apart locations along the longitudinal axis of the spool 41, the centerline of each annular groove being in a respective plane which is at least substantially perpendicular to the longitudinal axis of spool 41, thereby forming intervening annular lands 41*a*, 41*b*, 41*c*, and 41*d*.

A spiral coil spring 42 is positioned between an outwardly extending flange 43*a* of annular spring retainer 43 and an outwardly extending flange 44*a* of annular spring retainer 44. A bolt 45 extends through spring retainers 43 and 44 and is threadedly attached to the first end of the spool 41. A casing 46, which is secured to body 30 by any suitable means, has a first chamber 46*a*, a second chamber 46*b*, and a third chamber 46*c*, which are connected together and are preferably coaxial with spool bore 31. The diameter of the second chamber 46*b* is smaller than the diameter of the first chamber 46*a*, forming an inwardly directed annular shoulder 46*d* at the joindure of the two chambers. The diameter of the third chamber 46*c* is smaller than the diameter of the second chamber 46*b*, forming an inwardly directed annular shoulder 46*e* at the joindure of the two chambers. The annular flange 43*a* of the spring retainer 43 is slidably positioned within the first chamber 46*a*, while the annular flange 44*a* of the spring retainer 44 is slidably positioned in the second chamber 46*b*. The outer diameter of the annular flange 43*a* of spring retainer 43 is greater than the diameter of spool bore 31 and also greater than the diameter of the second chamber 46*b*. The annular flange 43*a* is mated with the first end of the spool 41 so that the spring retainer 43 is movable with spool 41 except when the annular flange 43*a* contacts the body 30 or the annular shoulder 46*d*. The outer diameter of the annular flange 44*a* of spring retainer 44 is greater than the diameter of the third chamber 46*c*, and the annular flange 44*a* of spring retainer 44 is biased toward the annular shoulder 46*e* by spring 42. The diameter of the head of bolt 45 is less than the diameter of the third chamber 46*c*, and the head of bolt 45 is exposed to the third chamber 46*c* and can be received therein for axial movement. Casing 46 has a passageway 46*f* in communication with the third chamber 46*c* for connection to pilot valve 22 to thereby apply a pilot pressure signal against the head of bolt 45 and thus effectively against the first end of spool 41.

An annular spring retainer 48 is positioned about the second end of spool 41 and has an outwardly extending annular flange 48*a* which is biased toward the body 30 by a spiral coil spring 47 which is retained under compression between casing 49 and the annular flange 48*a* of retainer 48. Casing 49 is secured to body 30 by any suitable means. The annular spring retainer 48 has an axially extending chamber 48*b* which is coaxial with the spool bore 31 and which accepts the second end of spool 41 for axial movement therein, while the outer end of the annular spring retainer 48 has an inwardly directed annular flange 48*c* to provide an opening 48*d* therethrough with a diameter smaller than the diameter of spool 41 so that spring retainer 48 can move with the spool 41 while the second end of spool 41 is in contact with the inwardly directed annular flange 48*c*. Casing 49 has a passageway 49*a* for connection to pilot valve 22 to thereby apply a pilot pressure signal through opening 48*d* in annular spring retainer 48 against the second end of spool 41.

Figure 2:
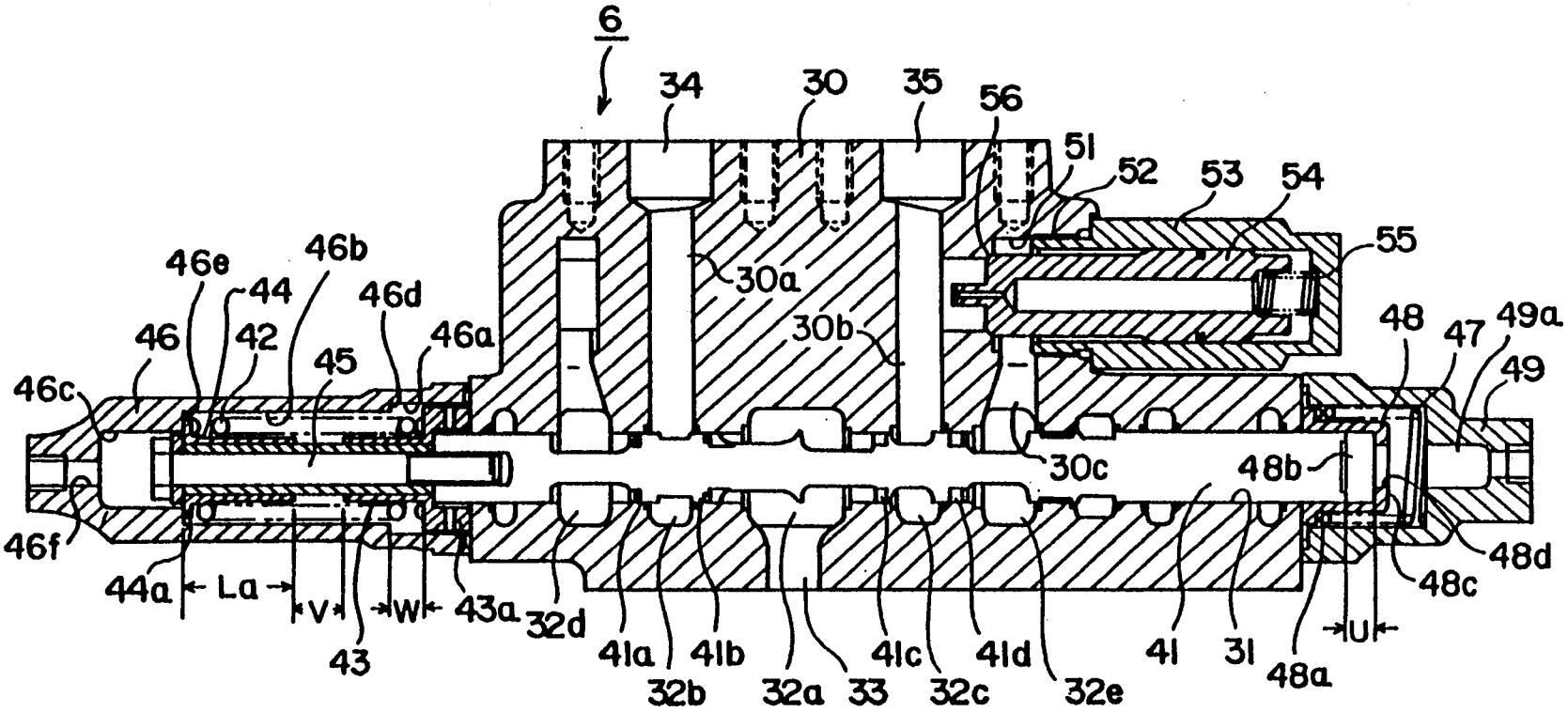
FIG. 2 is a sectional view illustrating the four-position closed-center selector valve shown in FIG. 1.

In the absence of a pilot pressure being applied against either end of spool 41, the spool 41 is positioned at the "hold" position by means of the spring 42 biasing the annular flange 44*a* of spring retainer 44 against the shoulder 46*e* and biasing the annular flange 43*a* of spring retainer 43 against the body 30, as illustrated in FIG. 2. When the spool 41 is in the "hold" position, the spring 47 holds the annular flange 48*a* of spring retainer 48 against body 30, and there is a gap of axial length U between the second end of the spool 41 and the inwardly directed flange 48*c* of spring retainer 48. At the "hold" position, the groove 32*b*, which is connected to the rod side 4A of the blade cylinder 4, is blocked by lands 41*a*, 41*b* of spool 41 from communication with either of the adjacent grooves 32*d*, 32*a*. Also, at the "hold" position, the groove 32*c*, which is connected to the bottom side 4B of the blade cylinder 4, is blocked by lands 41*c*, 41*d* from communication with either of the adjacent grooves 32*a*, 32*e*.

A pilot pressure signal can be transmitted from the pilot valve 22 to either the passageway 46*f* in casing 46 or the passageway 49*a* in casing 49, which are located at the opposite ends of the spool 41. When a first value of this pilot pressure is received in chamber 46*c* of the casing 46, pressure is effectively applied against the first end of spool 41 and the spool 41 is moved (to the right in FIG. 2) from the "hold" position, by a distance U to the "down" position. In the "down" position, the second end of spool 41 and the inwardly directed flange 48*c* of spring retainer 48 abut against each other while the annular flange 48*a* is maintained in contact with body 30 by the force of spring 47. In the "down" position, annular groove 32*a*, which is connected to the pump port 33, is blocked by land 41*b* from communication with adjacent annular groove 32*b* but is in communication via spool bore 31 with adjacent annular groove 32*c*, which is connected through passageway 30*b* and port 35 to the bottom side 4B of the blade cylinder 4. Also, in the "down" position, annular groove 32*b*, which is connected through passageway 30*a* and port 34 to the rod side 4A of the blade cylinder 4, is in communication with adjacent annular groove 32*d*, which is connected through the return conduit 8 to the reservoir tank 9. Annular groove 32*e* is blocked by land 41*d* from communication with adjacent annular groove 32*c*.

When the pilot pressure received in chamber 46*c* of the casing 46 is increased from the first value to a higher value which is sufficient to move the spool 41 and spring retainer 44 beyond the "down" position (further to the right in FIG. 2) the spring 47 is compressed. When the pilot pressure reaches a second value, which is substantially higher than the first value, so that the spool 41 is moved beyond the "down" position by a distance V, the outer end of the axial portion of the spring retainer 43 and the inner end of the axial portion of the spring retainer 44 abut each other and the spool 41 is in the "floating" position. In the "floating" position, annular groove 32*a*, which is connected to the pump port 33, is blocked by lands 41*b* and 41*c* from communication with adjacent annular grooves 32*b* and 32*c*. Also, in the "floating" position, annular groove 32*b*, which is connected through passageway 30*a* and port 34 to the rod side 4A of the blade cylinder 4, is in communication with adjacent annular groove 32*d*, which is connected through the return conduit 8 to the reservoir tank 9; while annular groove 32*c*, which is connected through passageway 30*b* and port 35 to the bottom side 4B of the blade cylinder 4, is in communication with adjacent annular groove 32*e*, which is connected through the return conduit 8 to the reservoir tank 9. Thus, both ports of the blade cylinder 4 are connected to the return conduit 8, and the blade is free to float up or down with variations in the ground surface.

When the pilot pressure is received in the passageway 49*a* of casing 49 and thus is applied to the second end of spool 41, the spool 41 is moved to the left (with respect to FIG. 2) from the "hold" position by a distance W to the "up" position. In the "up" position, the annular flange 43*a* of the spring retainer 43 and the annular shoulder 46*d* of casing 46 abut against each other, thereby preventing further leftward motion of either the spring retainer 43 or the spool 41. In the "up" position, annular groove 32*a*, which is connected to the pump port 33, is blocked by land 41*c* from communication with adjacent annular groove 32*c* but is in communication with adjacent annular groove 32*b*, which is connected through passageway 30*a* and port 34 to the rod side 4A of the blade cylinder 4. Also, in the "up" position, annular groove 32*c*, which is connected through passageway 30*b* and port 35 to the bottom side 4B of the blade cylinder 4, is in communication with adjacent annular groove 32*e*, which is connected through the return conduit 8 to the reservoir tank 9. Annular groove 32*d* is blocked by land 41*a* from communication with adjacent annular groove 32*b*.

A spool bore 51 having an internally threaded surface 52 is formed in the upper part of the body 30 in communication with the passageway 30*b* between annular grove 32*c* and port 35 and in communication with annular groove 32*e* via passageway 30*c*. A vacuum preventing valve casing 53 having external threads is screwed into the spool bore 52. A vacuum preventing valve 54 is closely but slidably fitted within the vacuum preventing casing 53, and is pressed against a seat 56 in the body 30 by means of a spring 55 to thereby interrupt the communication between the passageway 30*b* and the passageway 30*c* via the spool bore 51.

Figure 3:
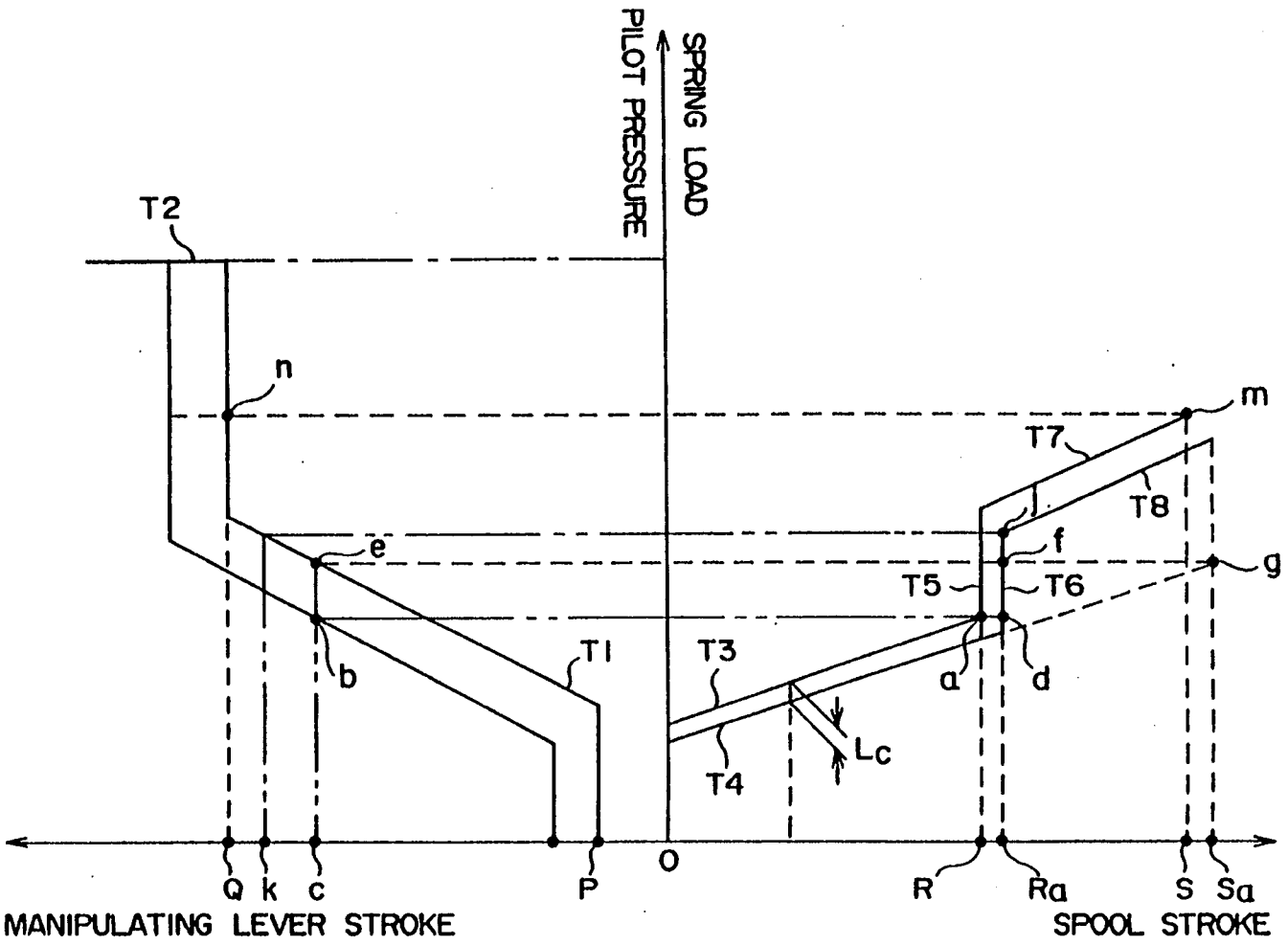
FIG. 3 is a graph showing relationships among control lever stroke, pilot pressure, valve spool stroke and spring load.

When a control lever 20, 20*a* is manipulated to move the valve spool of selector valve 5, 6 from the "hold" position, spools (not shown) in the pilot valves 21, 22 are moved so that the pilot pressure from the pilot pump 23 is increased in accordance with the magnitude of the stroke of the control lever 20, 20*a* as indicated by a straight line T1 from a predetermined lever position P shown in FIG. 3. Further, when the control lever 20, 20*a* comes to a predetermined stroke position Q, the pilot pressure becomes constant at a maximum value as indicated by a straight line T2 in accordance with the set relief pressure of the relief valve 24 which is disposed between the pilot pump 23 and the pilot valves 21, 22.

Figure 4:
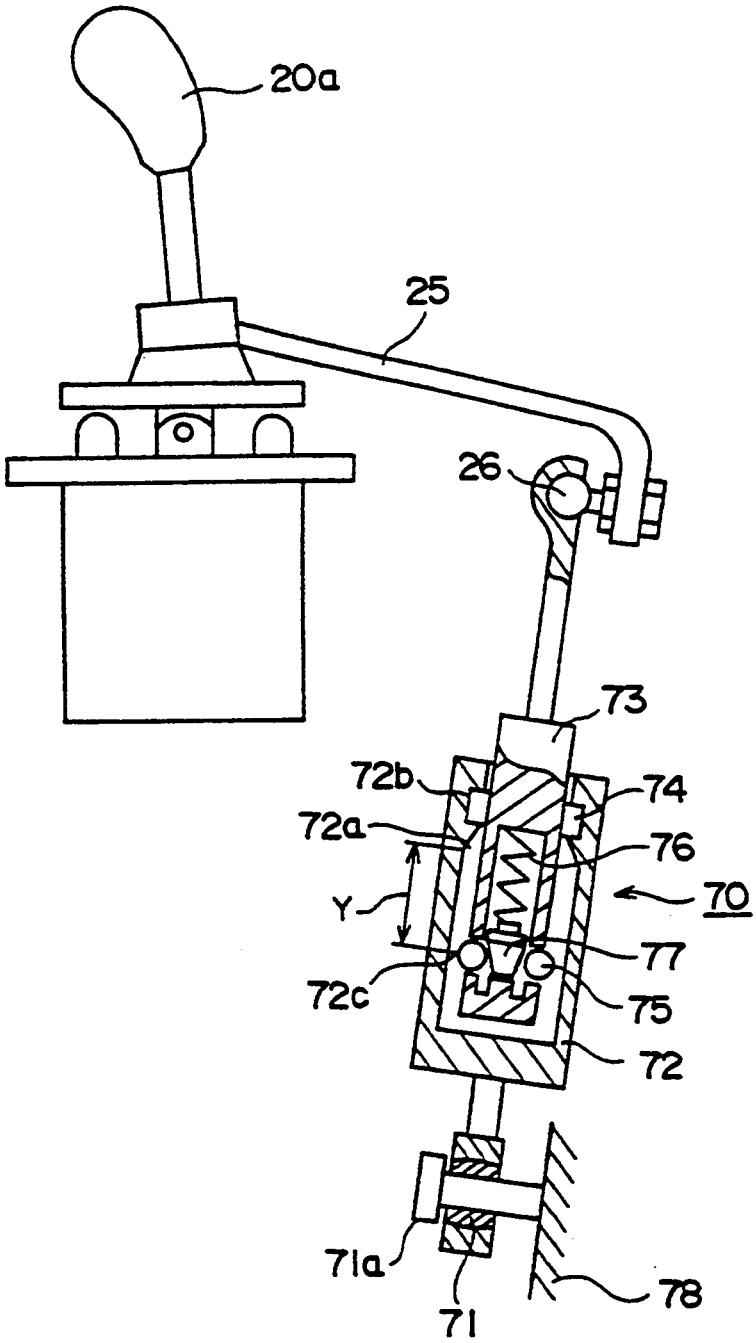
FIG. 4 is an explanatory view showing a relationship between a control lever and a detent device.
Figure 5:
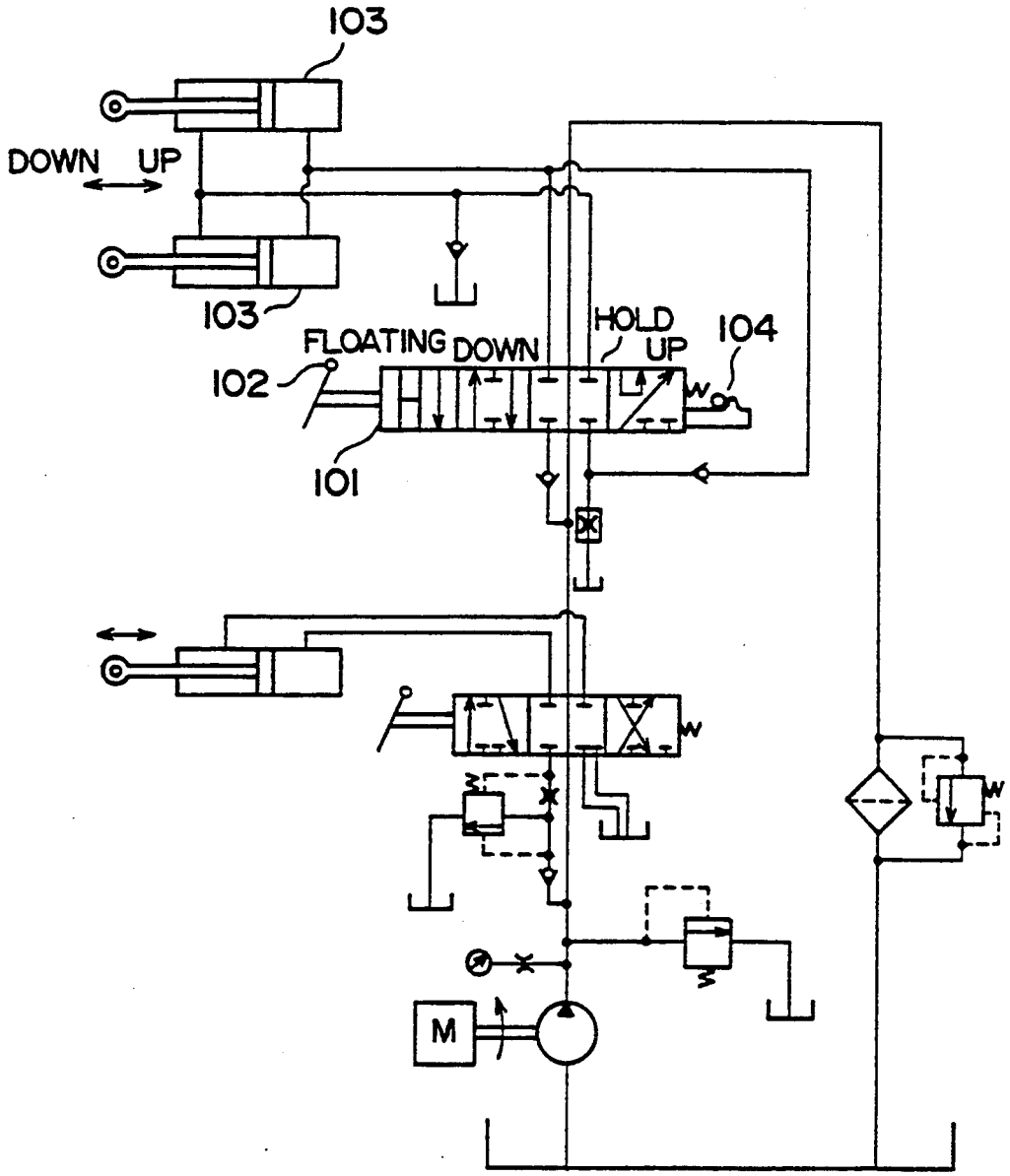
FIG. 5 PRIOR ART
FIG. 5 is a diagrammatic illustration of a conventional hydraulic circuit for a manually controlled four-position selector valve.

Next, a detent device according to the present invention will be detailed with reference to FIG. 4. One end of a rod 25 is secured to the control lever 20*a*, while the other end of the rod 25 is connected through the intermediary of a ball joint 26 to a detent device 70 for locking the four-position selector valve 6 at the "floating" position. The detent device 70 is composed of a detent casing 72 and a detent rod 73. A first end of the detent casing 72 is coupled through the intermediary of a ball joint 71 to a pin 71*a* fixed to a part 78 of the vehicle body. An axially extending bore 74 is formed in detent casing 72, opening through the second end of detent casing 72. The detent rod 73 extends through the second end of casing 72, with one end of the detent rod 73 being closely fitted in the bore 74 of the detent casing 72 and the other end of the detent rod 73 being coupled to the ball joint 26. The portion of the detent rod 73 coupled to the ball joint 26 can have a threaded means incorporated therein for adjustment of the effective length of the detent rod 73. The portion of the detent rod 73 within the casing 72 houses therein a plurality of balls 75, a spring 76 and a tapered detent lock 77. A portion of the bore 74 of the detent casing 72 is tapered inwardly so as to be gradually decreased from a "down" position 72*a* to the edge of an annular groove 72*b* formed in the wall of bore 74 of casing 72. When the detent rod 73 is moved outwardly from the casing 72, the balls 75 engage the tapered portion of the bore 74, forcing the tapered detent lock 75 to compress the spring 76, until the detent rod 73 reaches the "floating" position wherein the balls 75 can move radially outwardly into the groove 72*b*, thereby locking the detent rod 73 in the "floating" position.

The operation of the above-described embodiment of the invention is explained hereinafter. First, in the case of lowering the blade, the lever 20*a* shown in FIG. 4 is manipulated to move the balls 75 from the "hold" position 72*c* to the "down" position 72*a* of the detent device 70, which position can be manually sensed and discriminated. At this "down" position 72*a*, the pilot valve 22 is actuated so as to increase the pilot pressure of the pilot pump 23, and accordingly a pilot pressure in accordance with the magnitude of the stroke of the control lever 20*a* is fed to the chamber 46*c* in the casing 46 at the first end of the four-position selector valve 6. By this pilot pressure, the spool 41 (shown in FIG. 2) is shifted rightwardly by a distance U, overcoming the load of the spring 42, to the "down" position where the second end of the spool 41 abuts against the inwardly directed annular flange 48*c* of the spring retainer 48. This "down" position corresponds to a position R shown in FIG. 3. Further, hydraulic oil from the pump 2 flows into the bottom side 4B of the blade cylinder 4 via the annular groove 32*a*, the spool bore 31, the annular groove 32*c*, and passageway 30*b* so that the blade cylinder 4 is extended to lower the blade.

Next, in the case of floating the blade, the control lever 20*a* is manipulated to move the balls 75 to the groove 72*b* at the "floating" position of the detent device 70, which can be manually sensed and discriminated. At this "floating" position, the balls 75 are inserted into the groove 72*b* under the force of the spring 76 so as to lock the control lever 20*a*, and accordingly, the pilot valve 22 is again operated to further increase the pilot pressure of the pilot pump 23 so that a pilot pressure in accordance with the magnitude of the stroke of the control lever 20*a* is delivered to the chamber 46*c* in the casing 46 on the first end of the four-position selector valve 6. By this pilot pressure, the spool 41 is shifted rightwardly by a distance V, overcoming a load which is the combination (indicated by the straight line T7 in FIG. 3) of the force of the spring 42 and the force of the spring 47, to a position where the outer end of the axial portion of the spring retainer 43 and the inner end of the axial portion of the spring retainer 44 abut against each other. At this position the inner groove 32*b* and the inner groove 32*d* are in communication with each other via the spool bore 31, and accordingly, the rod side 4A of the blade cylinder 4 is connected to the tank 9. Similarly, the inner groove 32*c* and the inner groove 32*e* are in communication with each other via the spool bore 31, and accordingly, the bottom side 4B of the blade cylinder 4 is also connected to the tank 9. Thus, the blade comes into a floating condition which corresponds to the "floating" position which can be recognized during the manipulation of the control lever 20*a*. It is noted that although the hydraulic pressure from the pump 2 is blocked at the annular groove 32*a*, the load sensing valve 10 is operated so that the discharge pressure of the pump 2 is decreased to a low pressure.

The pressure from the pilot valve 22 for shifting the spool 41 during the above-mentioned operation is set by attaching loads and spring constants of the springs 42, 47, but the attaching loads and the spring constants are not uniform from one valve 6 to another valve 6 so that the spool stroke is also not uniform. That is, due to the nonuniformity of the mounting loads of the springs which is caused by variations in the dimensions of the spring retainers 43, 44, 48 such as the longitudinal dimension La of the spring retainer 43 or the overall length of the spool 41, or due to the nonuniformity of the spring constants of the springs 42, 47, the spring load for the spool stoke falls in a range Lc as shown in FIG. 3. Accordingly, even though the spool 41 of one valve 6 receives the identical value of pilot pressure as the spool 41 of another valve 6, the spool stroke may not be uniform.

Further, since the attaching positions of the control lever 20*a* and the detent device 70, as well as the manufacturing tolerance of the rod 25 or the detent rod 73, are not uniform from one valve to another, a distance Y between the "hold" position 72*c* and the "down" position 72*a* of the detent device 70, as shown in FIG. 3, is also not uniform from one valve to another. Accordingly, an error could be caused in the stroke of the control lever 20*a* so that the pilot pressure from the pilot valve 20*a* is deviated, resulting in the "floating" position 72*b* being effected even though the "down" position 72*a* is desired.

However, according to the present invention the spring 47, which abuts against the second end of the spool 41 at the "down" position, is provided in order to ensure the four positions. The reason why the four positions can be ensured with the provision of the spring 47 even though nonuniformity is present, will be explained with the use of the relationship between the stroke of the control lever 22*a* and the pilot pressure, and the relationship between the spool stroke and the spring load, as shown in FIG. 3.

The load of the spring 42 during the movement U to the "down" position, is not uniform from the zero position to the "down" position R in the spool stroke, as indicated by straight lines T3, T4, due to nonuniformity from one valve to another of the above-mentioned dimensions, springs or the like. Further, the spring load for the spool stroke during shifting from the "down" position R to the "floating" position S is not uniform, as indicated by straight lines T5, T6, since nonuniformity of the attaching load of the spring 47 is added. Further, the combination of the forces of the springs 42, 47 is not uniform from the "down" position R to the "floating" position S, as indicated by the straight lines T7, T8, due to the nonuniformity of the attaching load and the spring constants.

In order to ensure the "down" position R even with such nonuniformity, a point C on the stroke of the control lever 20*a* is set so as to obtain a maximum load point of nonuniformity at the "down" position R, that is, a pilot pressure point b corresponding thereto. For example, even though the spring 42 is weak, the spring 47 is deformed so that the stroke position comes to a point d on the straight line T6 even under the same pressure. Accordingly, the spool stroke is shifted by the spring 47 to a position Ra in the range of the "down" position R, and thereby, the "down" position can be ensured.

Further, even through the pilot pressure of the pilot valve 22 at the stroke point c of the control lever 20*a* is at a point e where the nonuniformity is maximum, the spring 47 deforms so that the stroke position comes to a point f on the straight line T6 even under the same pressure. Thus, with the spring 47 the spool stroke comes to the point Ra which is in the range of the "down" position R, and accordingly, the "down" position can be ensured.

Further, with the provision of the spring 47, the "floating" position cannot be precisely obtained at a spring load point j corresponding to the maximum point Ra of nonuniformity in the "down" position R, that is, a point K on the stroke of the control lever 20*a*. Accordingly, it is satisfactory that the distance between points C and K on the stroke of the control lever 20 is set to a distance (Y in FIG. 4) with which the above-mentioned nonuniformity in the manufacture of the detent device 70 is absorbed.

Figure 6:
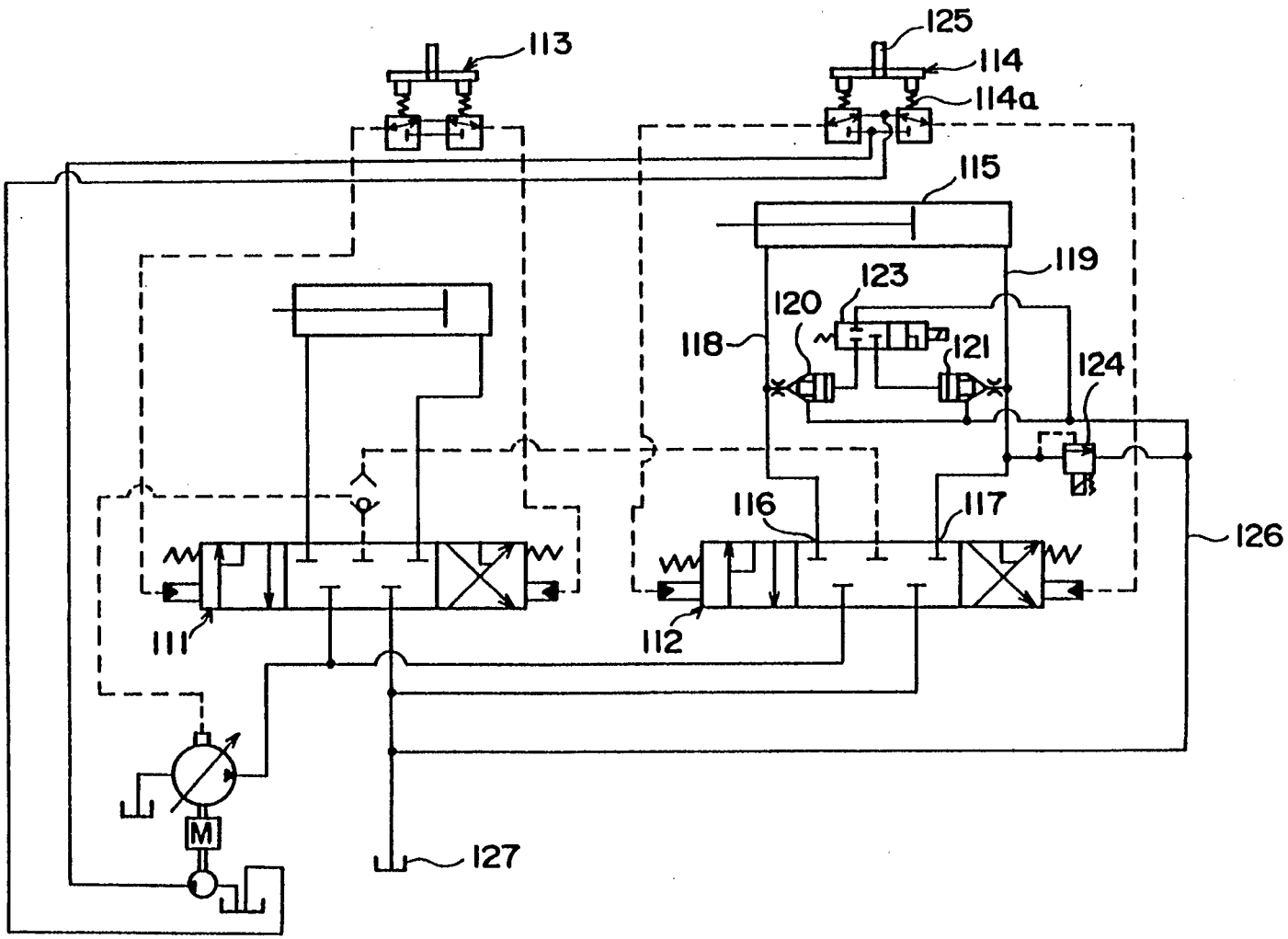
FIG. 6 PRIOR ART
FIG. 6 is a diagrammatic illustration of a conventional hydraulic circuit for a three-position closed-center selector valve controlled by a pressure proportional control valve.

In contrast, in the event that the spring is weak in the conventional arrangement as shown in FIG. 6, the spring load comes to a point g on the straight line T4, at a point e where the pilot pressure of the pilot valve 114 is maximum, and accordingly, it reaches a point Sa in the range of the "floating" position, and accordingly, floating motion is effected even through the "down" position is desired.

In addition, according to the present invention, even though the load to the spool 41 is not uniform even at the "floating" position S, in order to obtain a point m on the straight line T7 corresponding to the maximum load at the "floating" position S, a point n on the pilot pressure line corresponding thereto is obtained by the pressure of the relief valve 24. Further, the set pressure of the relief valve 24 is set to a value as indicated by the straight line T2, which is higher than the pilot pressure n in order to obtain the maximum spring load m at the "floating" position S. Accordingly, when the control lever stroke comes to a predetermined position Q by manipulating the control lever 20*a*, the "floating" position can be confirmed by confirming the pressure of the relief valve 24. Further, since the floating can be obtained by the set pressure of the relief valve 24 at the "floating" position S, the "floating" position S can be ensured without being affected by any nonuniformity of the pilot pressure from the pilot valve 22.

Reasonable variations and modifications are possible within the scope of the foregoing description, the drawings and the appended claims to the invention. For example, although the invention has been explained in such a manner that the spring 47 is arranged on the second end of the spool 41, the invention should not be limited thereto, but the spring 47 can be arranged on the first end of spool 41 so that the spring acts 47 after the spool 41 is shifted by a predetermined value. Similarly, the "up" position and the "down" position can be reversed. While the ball receiving portion of the bore 74 has been illustrated as an annular groove 72*b*, other forms of at least one ball receiving opening can be formed in a portion of the wall of bore 74. While the valve 6 has been illustrated with a bolt 45 to support the spring retainers 43 and 44, any other spool extension element extending outwardly at the first end of the valve spool 41 and having a retaining element at the outer end thereof could be employed, including an integral portion of the valve spool 41 itself.

What is claimed is:

1. Apparatus comprising:

a four-position closed-center selector valve, said four-position closed-center selector valve having a valve body and a valve spool; said valve body having an elongated spool bore therein, said spool bore having a longitudinal axis; said valve body having a fluid inlet port, a fluid outlet port, a first control port, a second control port, a first chamber, a second chamber, and a third chamber; said first chamber being connected to and positioned between said spool bore and said second chamber, said second chamber being connected to and positioned between said first and third chambers, the diameter of said first chamber being greater than the diameter of said spool bore so as to form a first annular shoulder at the joindure of said first chamber and said spool bore, the diameter of said first chamber being greater than the diameter of said second chamber so as to form a second annular shoulder at the joindure of said first and second chambers, the diameter of said second chamber being greater than the diameter of said third chamber so as to form a third annular shoulder at the joindure of said second and third chambers;

said valve spool having first and second opposing ends and being slidably positioned within said spool bore for movement along said longitudinal axis of said spool bore, said valve spool having four positions spaced along the longitudinal axis of said spool bore including a closed-center position as a "hold" position, a "first direction of operation" position, a "second direction of operation" position, and a "floating" position; wherein in said "hold" position the structure of said valve body and said valve spool blocks fluid communication between any of said fluid inlet port, said fluid outlet port, said first control port, and said second control port; wherein in said "first direction of operation" position the structure of said valve body and said valve spool provides a fluid communication passageway between said fluid inlet port and said first control port and a fluid communication passageway between said second control port and said fluid outlet port; wherein in said "second direction of operation" position the structure of said valve body and said valve spool provides a fluid communication passageway between said fluid inlet port and said second control port and a fluid communication passageway between said first control port and said fluid outlet port; wherein in said "floating" position the structure of said valve body and said valve spool provides a fluid communication passageway between said fluid outlet port and each of said first control port and said second control port while blocking fluid communication between said fluid inlet port and each of said first control port and said second control port;

a first spring retainer, a second spring retainer, and a spool extension element; said spool extension element extending outwardly at the first end of said valve spool and having a retaining element at the outer end thereof; each of said first and second spring retainers having an annular axial portion and an outwardly extending annular flange, the annular axial portion of each of said first and second spring retainers being slidably positioned on said spool extension element;

said annular flange of said first spring retainer being slidably positioned in said first chamber and having a diameter greater than the diameter of said spool bore and greater than the diameter of said second chamber, said annular flange of said second spring retainer being slidably positioned in said second chamber and having a diameter greater than the diameter of said third chamber;

a source of pilot pressure, a pressure proportional control valve, a first conduit connecting said source of pilot pressure to said pressure proportional control valve for producing a pilot pressure signal, a second conduit connecting said pressure proportional control valve to said third chamber, and a third conduit connecting said pressure proportional control valve to said spool bore adjacent said second end of said valve spool, so that said pressure proportional control valve can selectively apply said pilot pressure signal to one of said first and second opposing ends of said valve spool to cause said valve spool to change from one of its said positions to another of its said positions;

a first spring positioned between the annular flange of said first spring retainer and the annular flange of said second spring retainer to bias said valve spool to said "hold" position in the absence of a pilot pressure signal applied to either end of said valve spool;

wherein said valve spool is changed over from said "hold" position to said "first direction of operation" position by the application of said pilot pressure signal to said third chamber, wherein said valve spool is changed over from said "hold" position to said "second direction of operation" position by the application of a first value of said pilot pressure signal to said second end of said valve spool, and wherein said valve spool is changed over from said "hold" position to said "floating" position by the application of a second value of said pilot pressure signal to said second end of said valve spool;

whereby in said "hold" position said first spring biases said annular flange of said second spring retainer against said third annular shoulder and biases said annular flange of said first spring retainer against said first annular shoulder, with said first and second spring retainers being spaced apart from each other;

whereby in said "first direction of operation" position said annular flange of said first spring retainer is moved against said second annular shoulder while said first spring biases said annular flange of said second spring retainer against said third annular shoulder, with said first and second spring retainers being spaced apart from each other;

whereby in said "second direction of operation" position said first spring biases said annular flange of said second spring retainer against said retaining element at the outer end of said spool extension element and biases said annular flange of said first spring retainer against said first annular shoulder, with said first and second spring retainers being spaced apart from each other; and whereby in said "floating" position said first spring biases said annular flange of said second spring retainer against said retaining element at the outer end of said spool extension element and biases said annular flange of said first spring retainer against said first annular shoulder, with said first and second spring retainers being in contact with each other.

2. Apparatus in accordance with claim 1, wherein said four-position closed-center selector valve further comprises a second spring which is not affected by a shifting of said valve spool from said "hold" position to said "second direction of operation" position, but is affected by a shifting of said valve spool from said "second direction of operation" position to said "floating" position.

3. Apparatus in accordance with claim 2, wherein said valve body further comprises a fourth chamber joined to the end of the spool bore opposite from said first chamber, said fourth chamber having a diameter greater than the diameter of said spool bore so as to form a fourth annular shoulder at the joindure of said fourth chamber and said spool bore; wherein said four-position closed-center selector valve further comprises a third spring retainer, said third spring retainer being slidably positioned within said fourth chamber, said third spring retainer having an opening therein for receiving the second end of said valve spool, said second spring biasing said third spring retainer against said fourth annular shoulder in each of the positions of said valve spool other than said "floating" position; wherein in said "floating" position said second end of said valve spool overcomes said second spring and forces said third spring retainer away from said fourth annular shoulder.

4. Apparatus in accordance with claim 3, wherein said third conduit comprises a passageway in said valve body for providing communication between said fourth chamber and said pressure proportional control valve to enable said pilot pressure signal to be supplied to said fourth chamber, and wherein said third spring retainer has an opening therethrough exposing said second end of said valve spool to pilot pressure in said fourth chamber.

5. Apparatus in accordance with claim 4, further comprising a control lever for operating said pressure proportional control valve, and a detent device for fixing said pressure proportional control valve in a selected position.

6. Apparatus in accordance with claim 5, wherein said detent device is connected to said control lever by a ball joint.

7. Apparatus in accordance with claim 6, wherein said detent device comprises a detent casing and a detent rod, said detent casing having a bore therein with a portion of said bore in said detent casing having at least one ball receiving opening, said detent rod having first and second ends with said first end of said detent rod being disposed in said bore in said detent casing and said second end of said detent rod being coupled to said ball joint; and wherein said detent rod contains at least one ball, a spring, and a detent lock so that the spring in the detent rod forces said detent lock to bias said at least one ball toward said at least one ball receiving opening to thereby lock said detent rod with respect to said detent casing.

8. Apparatus in accordance with claim 1, wherein a source of hydraulic fluid is connected to said fluid inlet port.

9. Apparatus in accordance with claim 8, further comprising a hydraulic fluid actuator having a first port connected to said first control port, said hydraulic fluid actuator having a second port connected to said second control port, whereby the operation of said hydraulic fluid actuator is controlled by said four-position closed-center selector valve.

10. Apparatus in accordance with claim 1, wherein said second value of said pilot pressure signal is greater than said first value of said pilot pressure signal so that said valve spool is changed over from said "hold" position to said "second direction of operation" position by the application of said first value of said pilot pressure signal to said second end of said valve spool, and said valve spool is then changed over from said "second direction of operation" position to said "floating" position by the application of said second value of said pilot pressure signal to said second end of said valve spool.

11. Apparatus in accordance with claim 1, further comprising a relief valve connected to said first conduit so that a pilot pressure with which said valve spool is shifted by a maximum stroke is determined by a set relief pressure of said relief valve.

12. Apparatus in accordance with claim 1, further comprising a control lever for operating said pressure proportional control valve, and a detent device for fixing said pressure proportional control valve in a selected position.

13. Apparatus in accordance with claim 12, wherein said detent device is connected to said control lever by a ball joint.

14. Apparatus in accordance with claim 13, wherein said detent device comprises a detent casing and a detent rod, said detent casing having a bore therein with a portion of said bore in said detent casing having at least one ball receiving opening, said detent rod having first and second ends with said first end of said detent rod being disposed in said bore in said detent casing and said second end of said detent rod being coupled to said ball joint; and wherein said detent rod contains at least one ball, a spring, and a detent lock so that the spring in the detent rod forces said detent lock to bias said at least one ball toward said at least one ball receiving opening to thereby lock said detent rod with respect to said detent casing.

15. Apparatus comprising:

a four-position closed-center selector valve, said four-position closed-center selector valve having a valve body and a valve spool, said valve body having an elongated spool bore therein, said spool bore having a longitudinal axis, said valve spool having first and second opposing ends and being slidably positioned within said spool bore for movement along said longitudinal axis of said spool bore, said valve spool having four positions spaced along the longitudinal axis of said spool bore including a closed-center position as a "hold" position, a "first direction of operation" position, a "second direction of operation" position, and a "floating" position; said valve body having an inlet port, an outlet port, a first control port, and a second control port; wherein in said "hold" position the structure of said valve body and said valve spool blocks fluid communication between any of said inlet port, said outlet port, said first control port, and said second control port; wherein in said "first direction of operation" position the structure of said valve body and said valve spool provides a fluid communication passageway between said inlet port and said first control port and a fluid communication passageway between said second control port and said outlet port; wherein in said "second direction of operation" position the structure of said valve body and said valve spool provides a fluid communication passageway between said inlet port and said second control port and a fluid communication passageway between said first control port and said outlet port; wherein in said "floating" position the structure of said valve body and said valve spool provides a fluid communication passageway between said outlet port and each of said first control port and said second control port while blocking fluid communication between said inlet port and each of said first control port and said second control port;

a source of pressurized hydraulic fluid, a first conduit connecting said source of pressurized hydraulic fluid to said inlet port;

a hydraulic actuator having a first actuator port and a second actuator port, a second conduit connecting said first control port to said first actuator port, a third conduit connecting said second control port to said second actuator port;

a source of pilot pressure, a pressure proportional control valve, a fourth conduit connecting said source of pilot pressure to said pressure proportional control valve for producing a pilot pressure signal, a fifth conduit connecting said pressure proportional control valve to said spool bore adjacent said first end of said valve spool, and a sixth conduit connecting said pressure proportional control valve to said spool bore adjacent said second end of said valve spool so that said pressure proportional control valve can selectively apply said pilot pressure signal to one of said first and second opposing ends of said valve spool to cause said valve spool to change from one of its said positions to another of its said positions;

wherein said valve spool is changed over from said "hold" position to said "first direction of operation" position by the application of said pilot pressure signal to said first end of said valve spool, wherein said valve spool is changed over from said "hold" position to said "second direction of operation" position by the application of a first value of said pilot pressure signal to said second end of said valve spool, and wherein said valve spool is changed over from said "hold" position to said "floating" position by the application of a second value of said pilot pressure signal to said second end of said valve spool;

a control lever for operating said pressure proportional control valve, and a detent device for fixing said pressure proportional control valve in a selected position, said detent device being connected to said control lever by a ball joint;

wherein said detent device comprises a detent casing and a detent rod, said detent casing having a bore therein with a portion of said bore in said detent casing having at least one ball receiving opening, said detent rod having first and second ends with said first end of said detent rod being disposed in said bore in said detent casing and said second end of said detent rod being coupled to said ball joint; and wherein said detent rod contains at least one ball, a spring, and a detent lock so that the spring in the detent rod forces said detent lock to bias said at least one ball toward said at least one ball receiving opening to thereby lock said detent rod with respect to said detent casing.

* * * * *